US007337589B2

(12) United States Patent
Meyer

(10) Patent No.: US 7,337,589 B2
(45) Date of Patent: Mar. 4, 2008

(54) INTERLOCKING BLOCKS FOR CONSTRUCTION

(76) Inventor: Michael R. Meyer, 116 E. Crapo St., Alpena, MI (US) 49707

( * ) Notice: Subject to any disclaimer, the term of this patent is extended or adjusted under 35 U.S.C. 154(b) by 441 days.

(21) Appl. No.: 10/876,793

(22) Filed: Jun. 25, 2004

(65) Prior Publication Data

US 2005/0284092 A1 Dec. 29, 2005

(51) Int. Cl.
*E04B 2/08* (2006.01)

(52) U.S. Cl. ..... 52/592.5; 52/286; 52/592.6; 52/606; 52/612

(58) Field of Classification Search ..... 52/598, 52/504, 605, 590.1, 590.3, 592.1, 592.4, 52/284, 286, 589.1, 591.1, 592.5, 592.6, 52/606, 612

See application file for complete search history.

(56) References Cited

U.S. PATENT DOCUMENTS 868,838 A 10/1907 Brewington
1,502,438 A * 7/1924 Price ..... 52/259
2,877,506 A * 3/1959 Almoslino ..... 52/223.7
3,102,367 A * 9/1963 Martin et al. ..... 52/592.2
3,732,653 A * 5/1973 Pickett ..... 52/71
4,627,209 A 12/1986 Schwartz
4,854,103 A * 8/1989 Klym ..... 52/592.6
4,982,535 A * 1/1991 Pickett ..... 52/71
5,003,746 A * 4/1991 Wilston ..... 52/592.1
5,134,815 A * 8/1992 Pickett ..... 52/71
5,154,032 A * 10/1992 Ritter ..... 52/592.1
5,181,362 A * 1/1993 Benitez ..... 52/591.1
5,230,194 A * 7/1993 McClure ..... 52/591.4
5,536,111 A * 7/1996 Doernemann ..... 405/16
5,548,938 A * 8/1996 Scheiwiller ..... 52/604
5,615,529 A * 4/1997 Johnson et al. ..... 52/604

* cited by examiner

*Primary Examiner*—Yvonne M. Horton
(74) *Attorney, Agent, or Firm*—Donald J. Ersler

(57) ABSTRACT

Interlocking blocks for construction preferably include an in-line block, a corner block, an offset block and end blocks. The in-line block includes a connector extension disposed on one end and a connector cavity formed on the opposite end thereof. The connector cavity is sized to receive the connector extension. First and second retention projections preferably extend from a face of the in-line block. The corner block preferably includes the connector extension formed on one end and the connector cavity formed in a side at the opposite end thereof. The offset block includes the connector extension formed on one side at one end and the connector cavity formed on the opposite side at the opposite end thereof. The end block includes a connector extension or a connector cavity disposed on one end. At least one cavity is formed through each block.

20 Claims, 10 Drawing Sheets

INTERLOCKING BLOCKS FOR CONSTRUCTION

BACKGROUND OF THE INVENTION

1. Field of the Invention

The present invention relates generally to construction of walls and more specifically to interlocking blocks for construction, which allows a wall to be constructed with less skilled labor.

2. Discussion of the Prior Art

Interlocking blocks for building walls are well known in the art. There are at least two patents that disclose interlocking blocks for constructing walls. U.S. Pat. No. 868,838 to Brewington discloses a concrete building block. The Brewington patent includes a concrete building block having a Maltese extension on one end and a Maltese slot on the other end that is sized to receive the Maltese extension. Two cross bars are formed in a bottom of each concrete building block that are sized to be received by cavity in a top of the concrete building block.

One drawback to the Brewington patent is that the Maltese extension and Maltese slot are subject to stress cracking, due to the sharp corners. Settling of a building will causes the concrete building blocks to move relative to each other and produce stress at the sharp corners of the Maltese slots and extensions. Further, the Brewington patent does not disclose transverse webs. Traverse webs improve the ability of a concrete block to act as a fire wall.

U.S. Pat. No. 4,627,209 to Schwartz discloses interlocking blocks and construction system comprising said blocks. The Schwartz patent includes a monolithic masonry building block capable of controlled alignment in vertical and horizontal directions and provides a wall structure having vertical and horizontal grooves which can be filled with a bonding agent.

Accordingly, there is a clearly felt need in the art for interlocking blocks for construction, which require less skilled labor to construct a wall than that of the prior art; may be retained relative to each other with a bonding agent other than mortar, may be dry stacked; and include in-line blocks, corner blocks, end blocks and offset blocks.

SUMMARY OF THE INVENTION

The present invention provides interlocking blocks for construction, which does not require skilled labor for assembly. The interlocking blocks for construction (interlocking blocks) preferably include an in-line block, a corner block, an offset block, and end blocks. The in-line block includes a connector extension disposed on one end of the in-line block and a connector cavity formed on the opposite end thereof. The connector cavity of a first in-line block is sized to receive the connector extension of a second in-line block. A first retention projection preferably extends from a top face or a bottom face of the in-line block, adjacent the connector extension. A second retention projection preferably extends from a top face or a bottom face of the in-line block, adjacent the connector cavity.

Preferably, a first cavity is formed adjacent the first retention projection, a second cavity is formed adjacent the second retention projection and a middle cavity is formed between the first and second cavities. The middle cavity of a first in-line block and the middle cavity of a second in-line block are sized to receive the first and second retention projections of a third in-line block stacked upon the first and second in-line blocks.

The corner block includes the connector extension formed on one end and the connector cavity formed in a side at the opposite end thereof. Preferably, a first cavity is formed adjacent the connector extension, a second cavity is formed adjacent the connector cavity and a middle cavity is formed between the first and second cavities. The offset block includes the connector extension formed on one side at one end and the connector cavity formed on the opposite side at the opposite end thereof. Preferably, a first cavity is formed adjacent a first end of the offset block, a second cavity is formed adjacent the connector cavity and a middle cavity is formed between the first and second cavities. Each end block includes a connector extension or a connector cavity disposed on one end. The end block may have the same length as the in-line block or a smaller length.

Accordingly, it is an object of the present invention to provide interlocking blocks, which require less skilled labor to construct a wall than that of the prior art.

It is a further object of the present invention to provide interlocking blocks, which may be retained relative to each other with a bonding agent other than mortar.

It is yet a further object of the present invention to provide interlocking blocks, which may be dry stacked.

Finally, it is another object of the present invention to provide interlocking blocks, which include corner, end and offset blocks in addition to in-line blocks.

These and additional objects, advantages, features and benefits of the present invention will become apparent from the following specification.

DETAILED DESCRIPTION OF THE PREFERRED EMBODIMENTS

Figure 1:
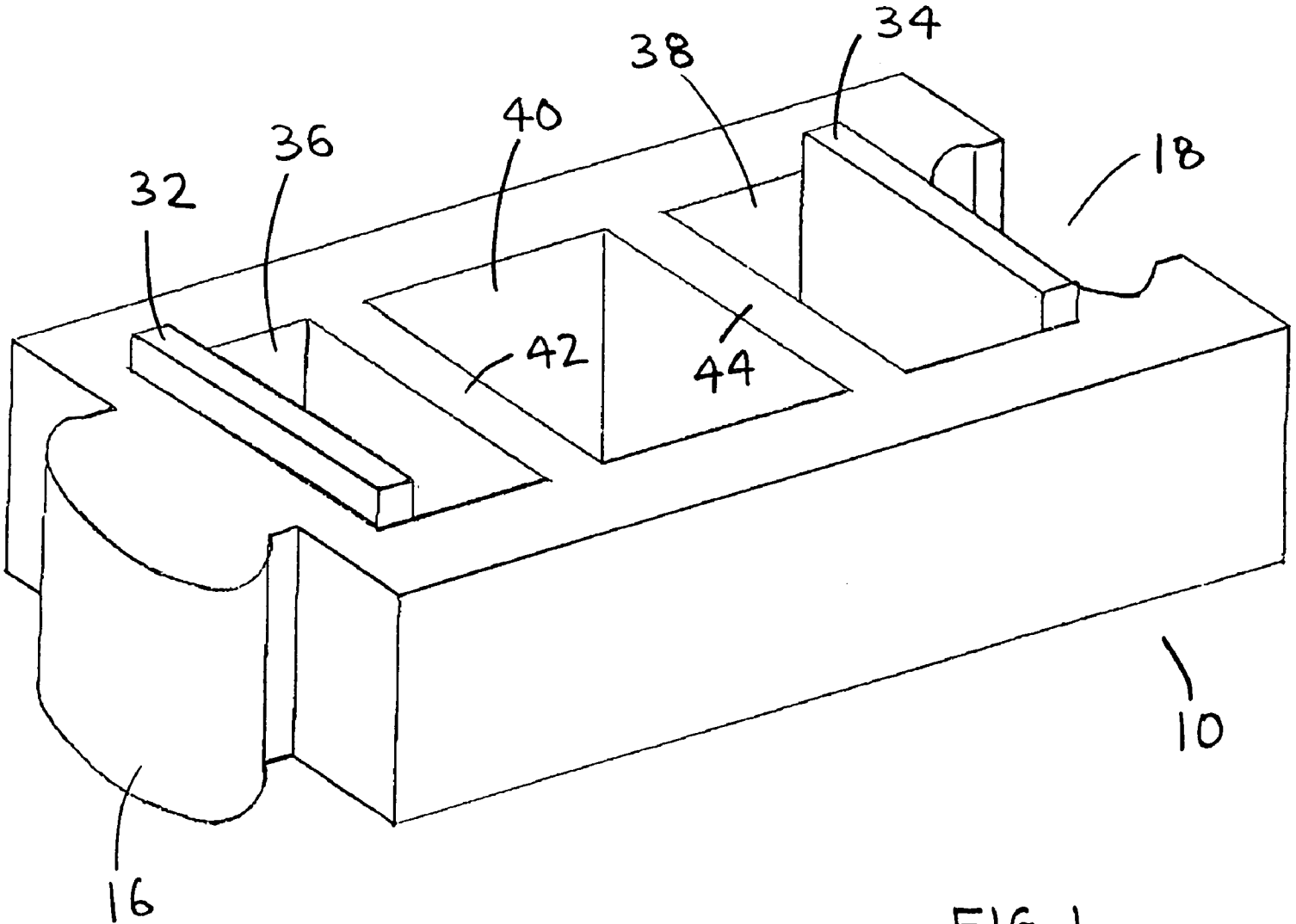
FIG. 1 is a perspective view of an in-line block in accordance with the present invention.
Figures 2, 3:
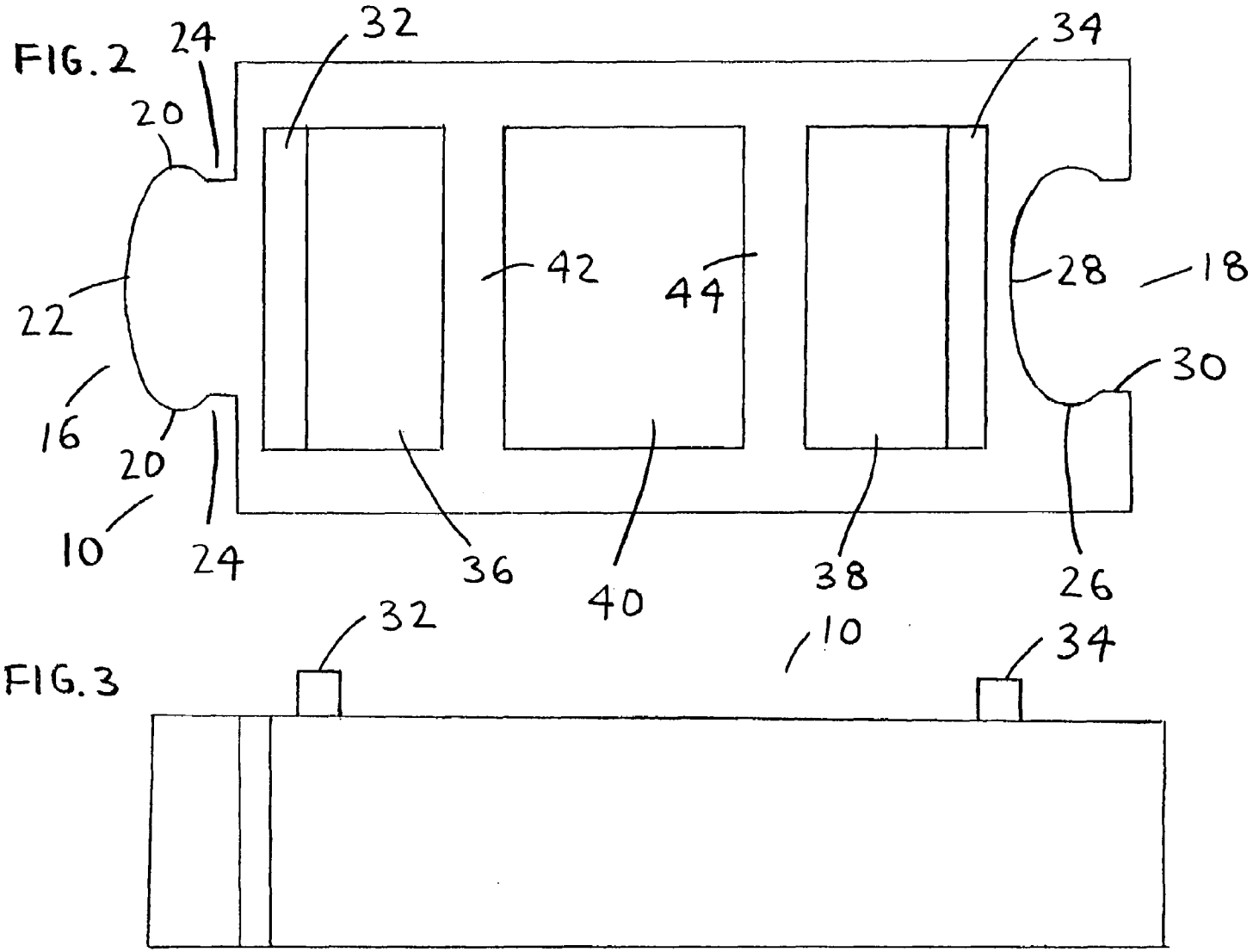
FIG. 2 is a top view of an in-line block in accordance with the present invention.
FIG. 3 is a side view of an in-line block in accordance with the present invention.
Figure 10:
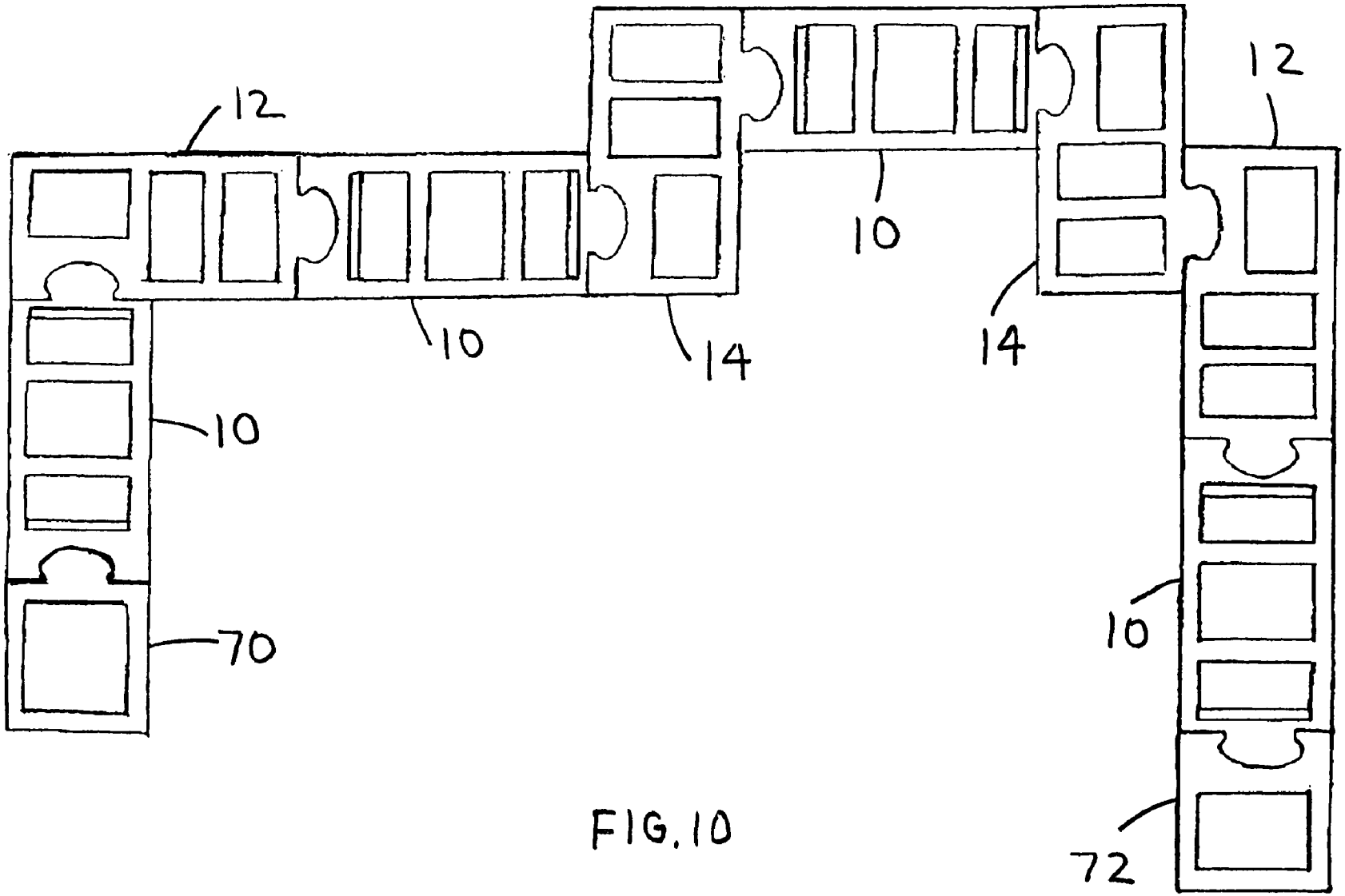
FIG. 10 is a top view of a plurality of interlocking blocks connected to each other in accordance with the present invention.
Figure 11:
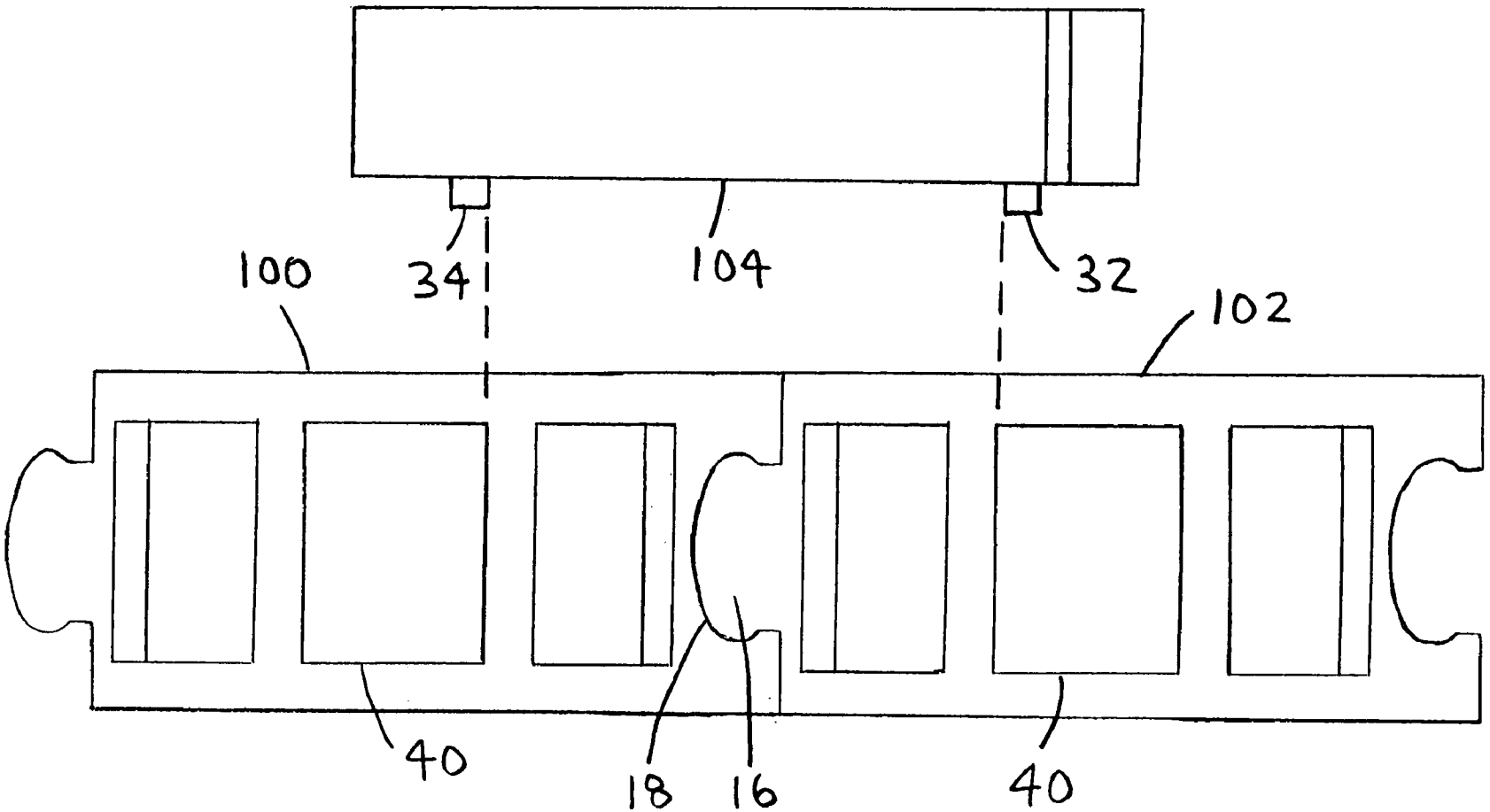
FIG. 11 is a top view of first and second in-line blocks attached to each other with a third in-line block tipped on a side and aligned for attached to the first and second in-line blocks in accordance with the present invention.
Figure 12:
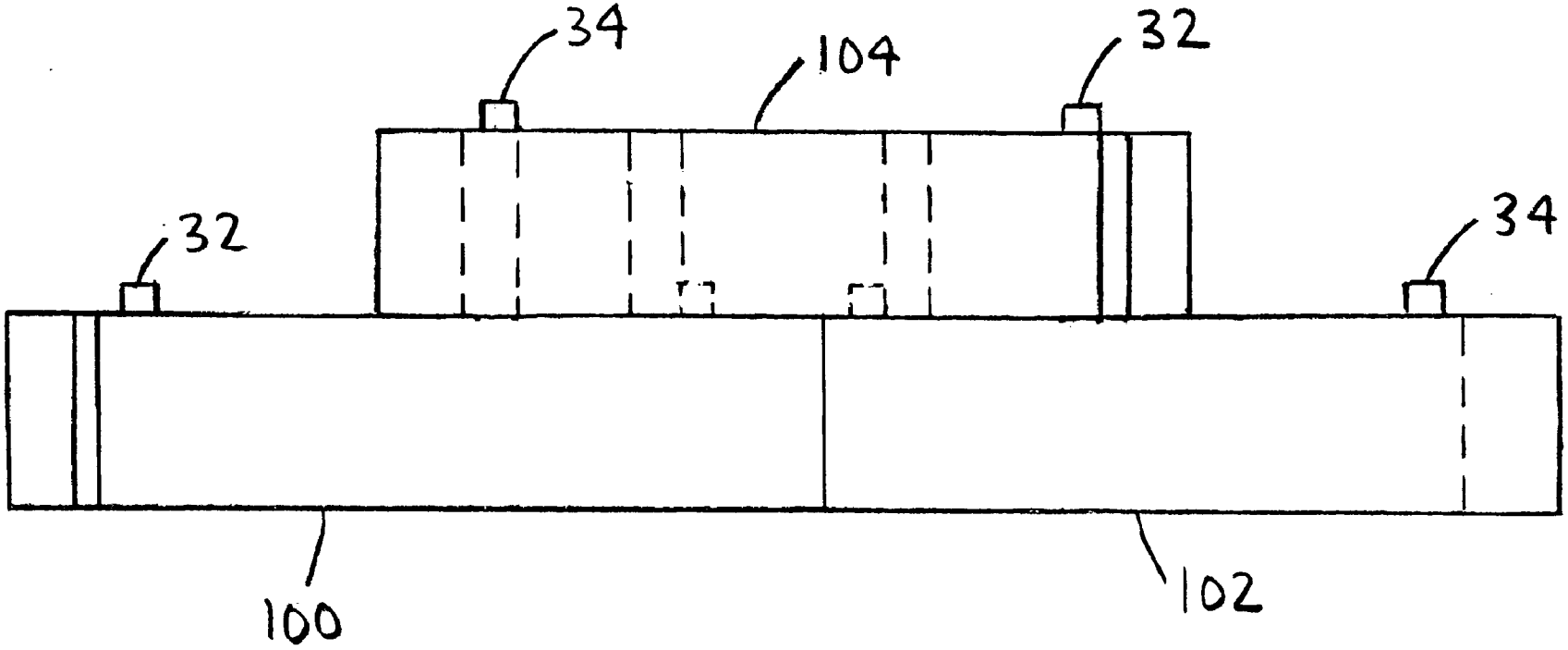
FIG. 12 is a side view of first, second and third in-line blocks engaged with each other in accordance with the present invention.

With reference now to the drawings, and particularly to FIG. 10, there is shown a top view of a plurality of interlocking blocks connected to each other. With reference to FIGS. 1–3, the plurality of interlocking blocks include an in-line block 10, a corner block 12, an offset block 14, and end blocks 70, 72. The in-line block 10 includes a connector extension 16 disposed on one end of the in-line block 10 and a connector cavity 18 formed on the opposite end thereof. With reference to FIG. 11, the connector cavity 18 of a first in-line block 100 is sized to receive the connector extension 16 of a second in-line block 102. The connector extension 16 preferably includes a pair of rounded ends 20 and a front curved surface 22. Each end of the front curved surface extends from a single rounded end 20. An undercut side 24 is preferably formed between the one end of the in-line block 10 and each rounded end 20.

The connector cavity 18 includes a pair of inner rounded ends 26, an inner curved surface 28 and a pair of side surfaces 30, which are sized to receive the pair of rounded ends 20, the front curved surface 22 and the two undercut sides 24 of the connector extension 16, respectively. A first retention projection 32 preferably extends from a top face or a bottom face of the in-line block 10, adjacent the connector extension 16. A second retention projection 34 preferably extends from a top face or a bottom face of the in-line block 10, adjacent the connector cavity 18. Preferably, a first cavity 36 is formed adjacent the first retention projection 32, a second cavity 38 is formed adjacent the second retention projection 34 and a middle cavity 40 is formed between the first and second cavities. A first web 42 is created between the first and middle cavities and a second web 44 is created between the middle and second cavities. The use of webs 42, 44 increase the fire rating of the in-line block 10. With reference to FIG. 11, the middle cavity 40 of a first in-line block 100 and the middle cavity 40 of a second in-line block 102 are sized to receive the first and second retention projections of a third in-line block 104 stacked upon the first and second in-line blocks.

Figure 4:
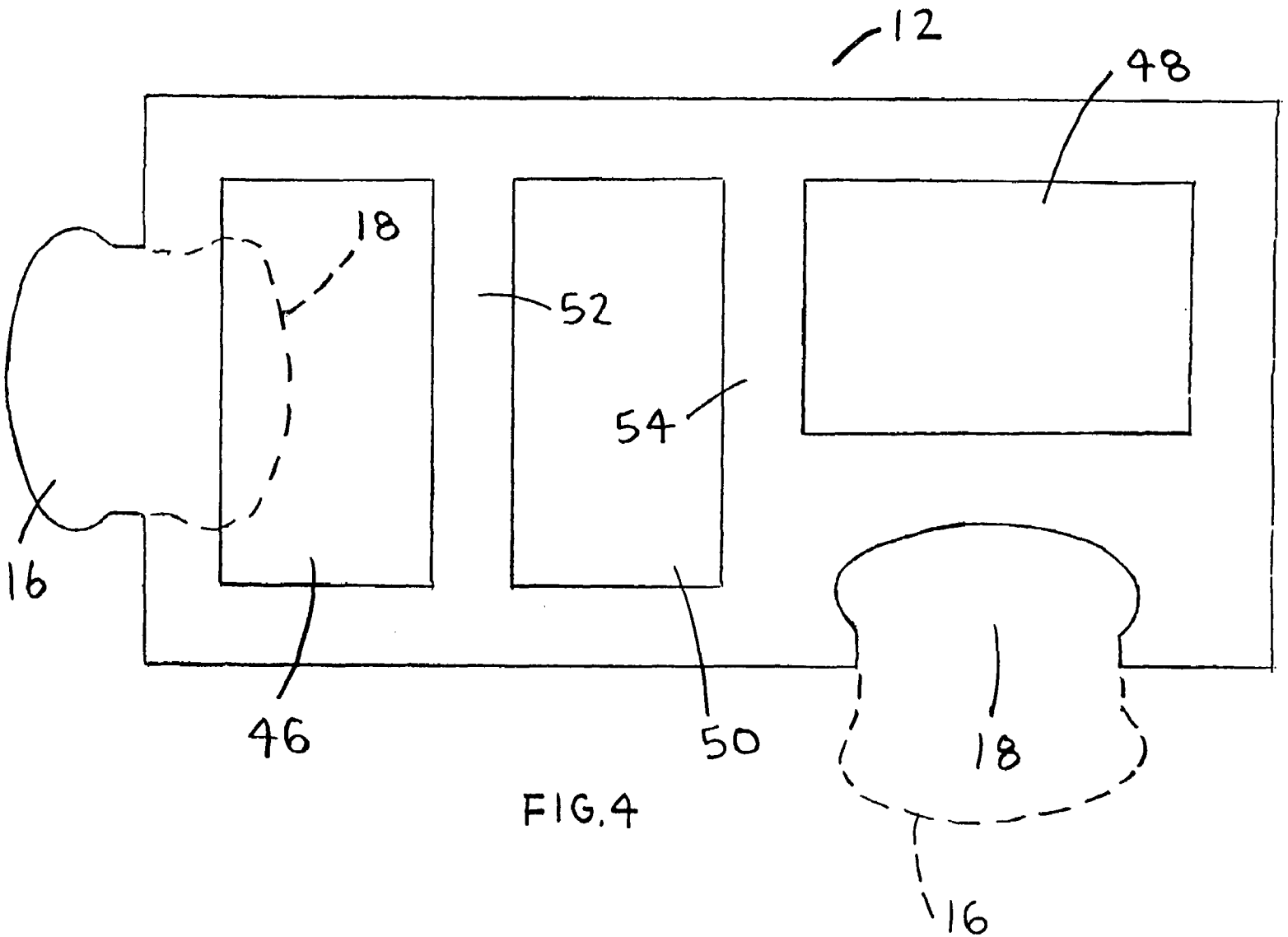
FIG. 4 is a top view of a corner block in accordance with the present invention.

With reference to FIG. 4, the corner block 12 includes the connector extension 16 formed on one end and the connector cavity 18 formed in a side at the opposite end thereof. Preferably, a first cavity 46 is formed adjacent the connector extension 16, a second cavity 48 is formed adjacent the connector cavity 18 and a middle cavity 50 is formed between the first and second cavities. A first web 52 is created between the first and middle cavities and a second web 54 is created between the middle and second cavities. The corner block 12 may be flipped over in use as shown in FIG. 10. The position of the connector extension 16 may be swapped with the position of the connector cavity 18 as represented by dash lines as well as the first and second cavities.

Figure 5:
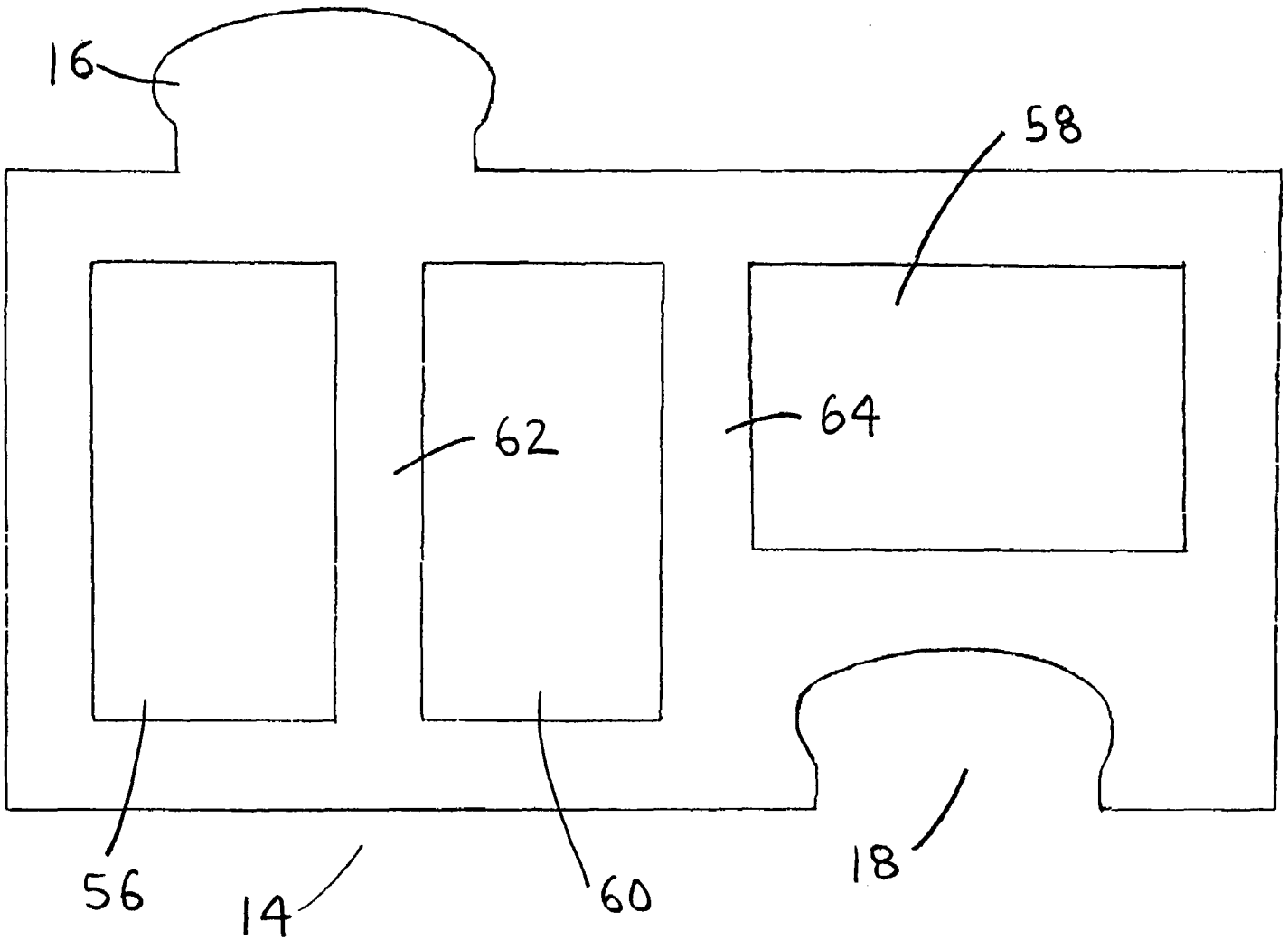
FIG. 5 is a top view of an offset block in accordance with the present invention.
Figure 6:
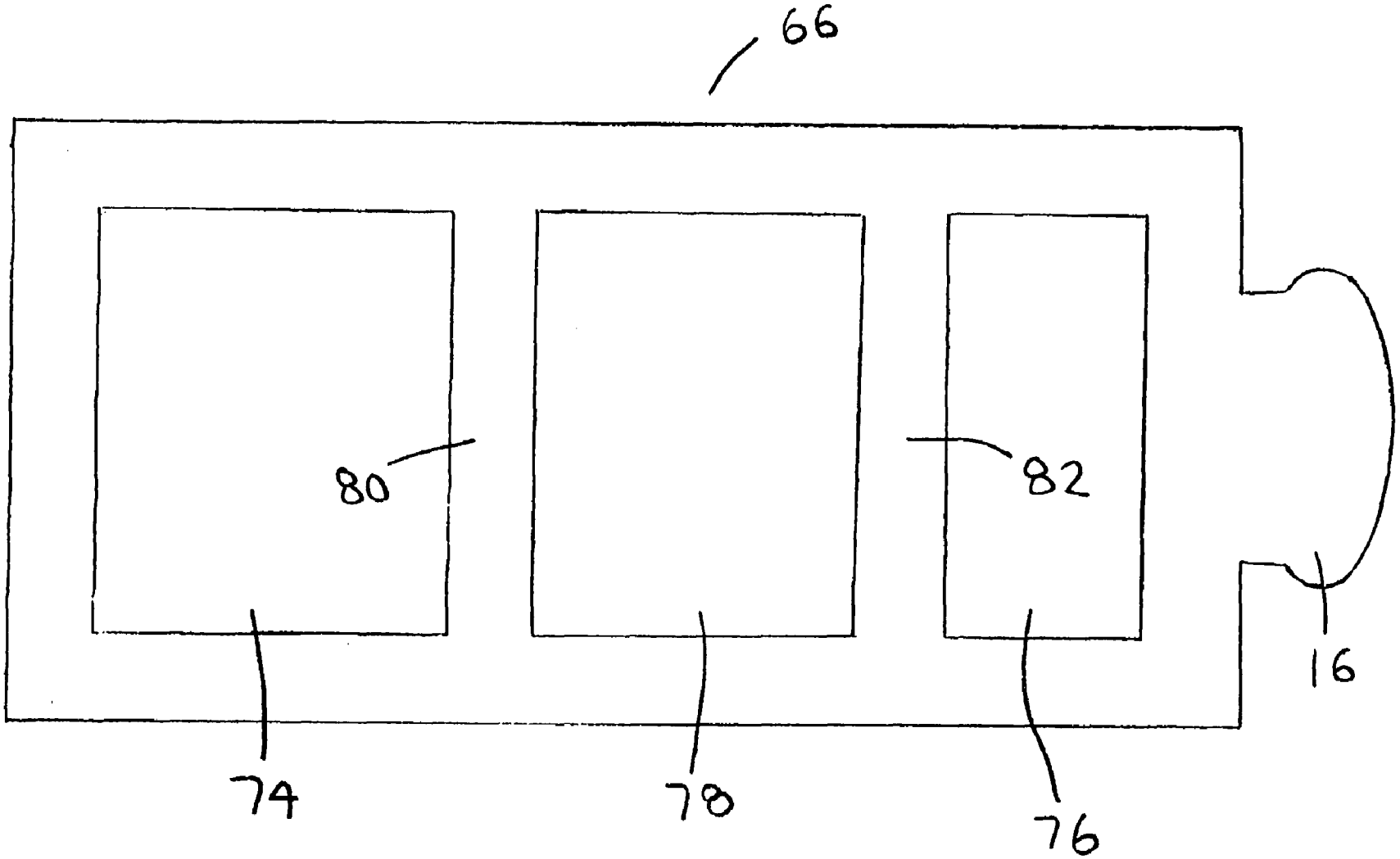
FIG. 6 is a top view of a full length male end block in accordance with the present invention.
Figure 7:
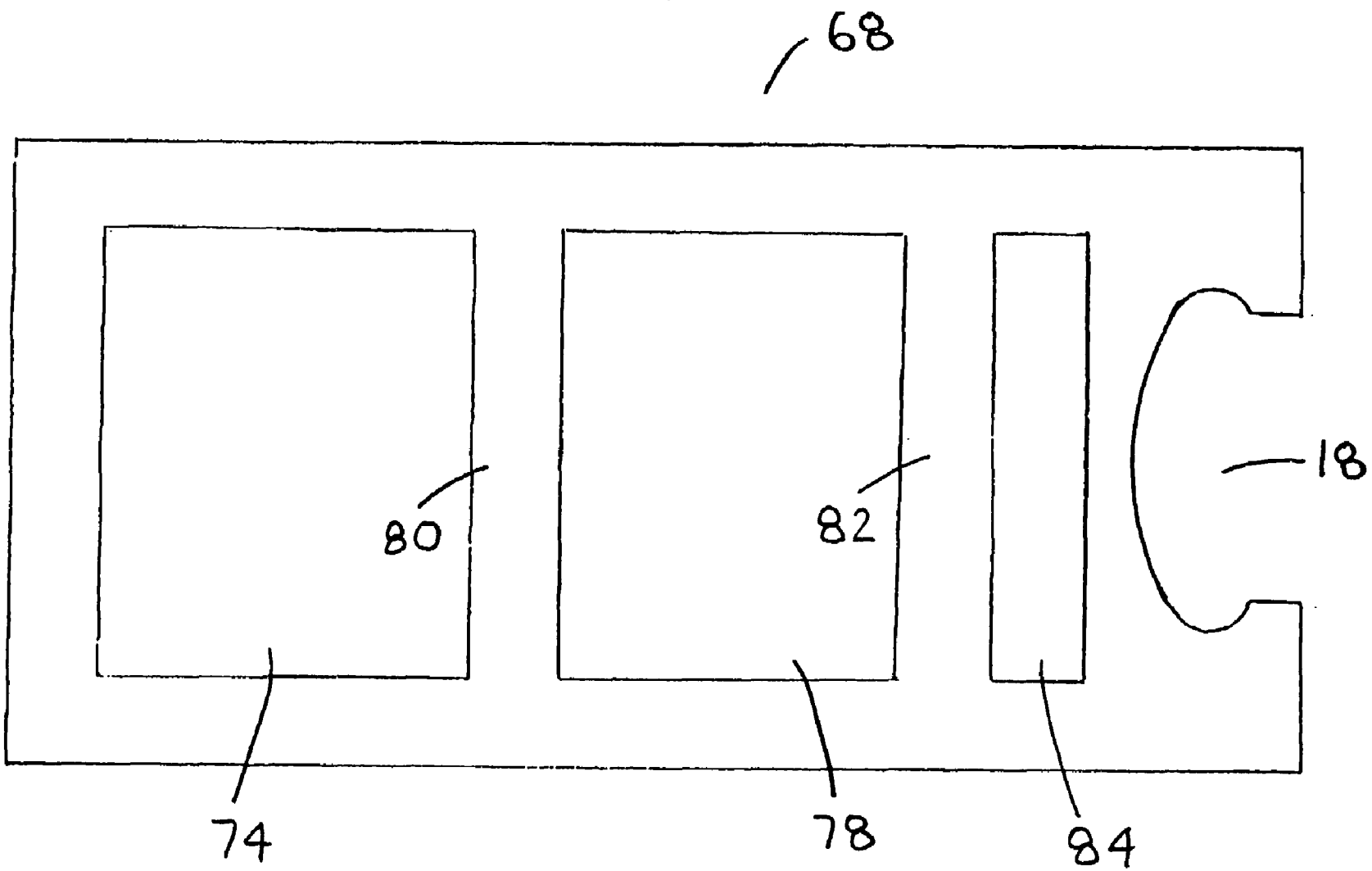
FIG. 7 is a top view of a full length female end block in accordance with the present invention.
Figure 9:
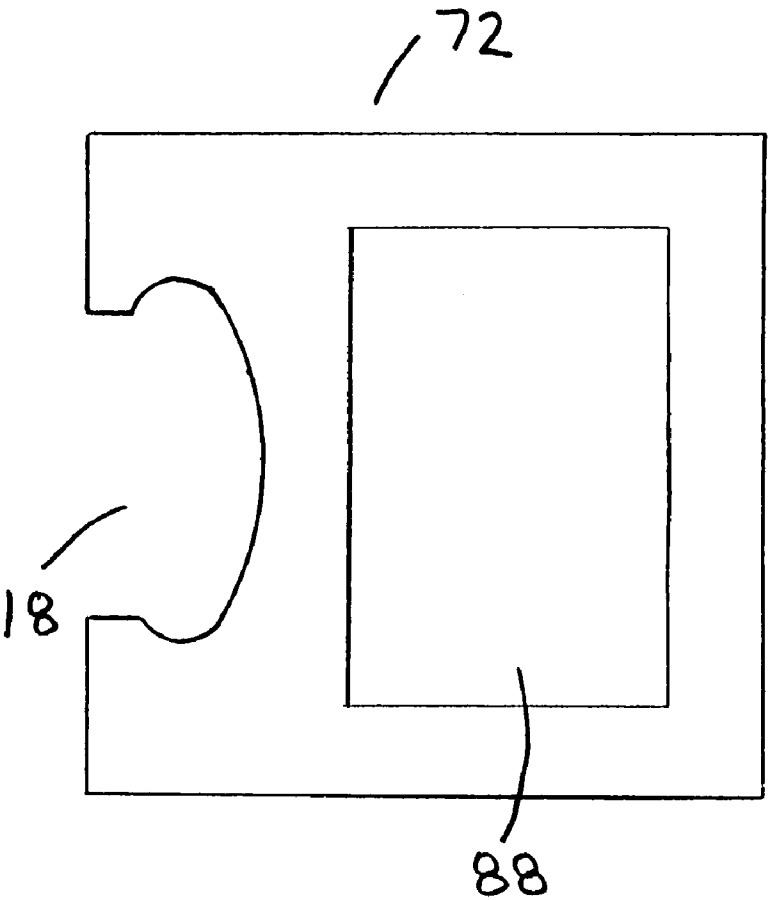
FIG. 9 is a top view of a partial length female end block in accordance with the present invention.
Figure 8:
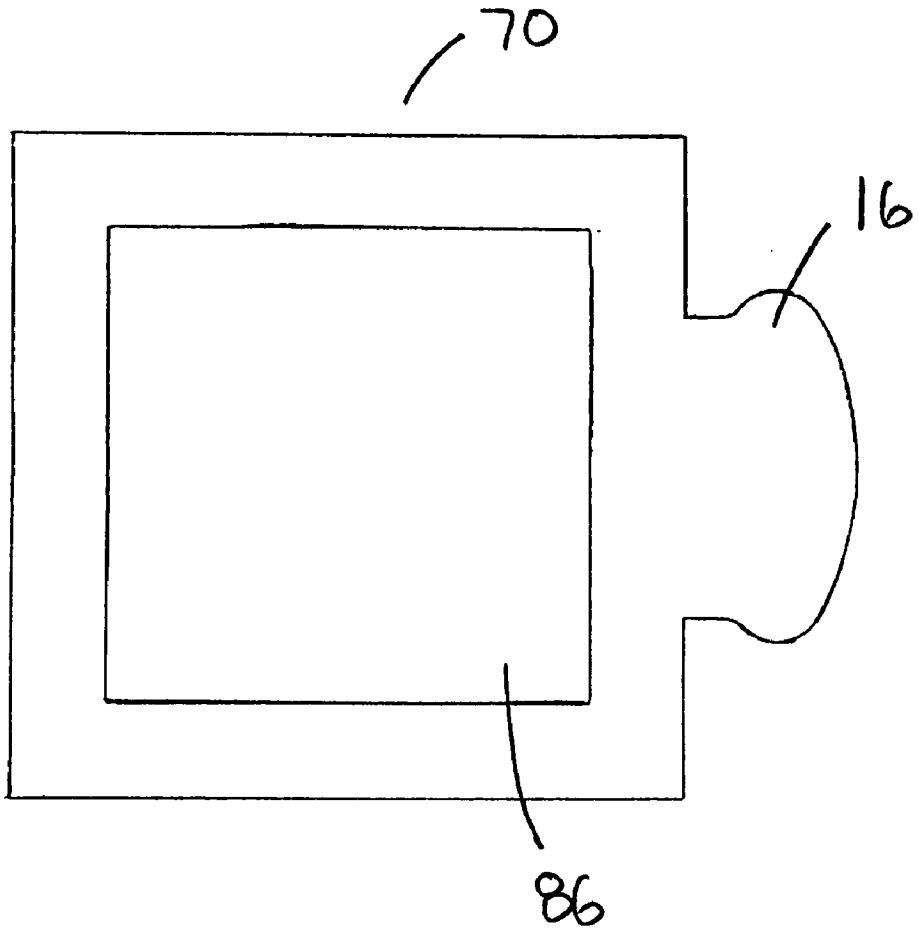
FIG. 8 is a top view of a partial length male end block in accordance with the present invention.

With reference to FIG. 5, the offset block 14 includes the connector extension 16 formed at a first end, on one side and the connector cavity 18 formed on the second end in the opposite side thereof. Preferably, a first cavity 56 is formed adjacent a first end of the offset block 14, a second cavity 58 is formed adjacent the connector cavity 18, and a middle cavity 60 is formed between the first and second cavities. A first web 62 is formed between the first and middle cavities and a second web 64 between the middle and second cavities. The offset block 14 may be flipped over in use as shown in FIG. 10.

With reference to FIGS. 6–9, the end blocks preferably include the embodiments of a full length male end block 66, a full length female end block 68, a partial length male end block 70 and a partial length female end block 72. The full length male end block 66 includes the connector extension 16 on one end. A first cavity 74 is formed on the other end of the full length male end block 66 and a second cavity 76 is formed adjacent the connector extension 16. A middle cavity 78 is formed between the first and second cavities. A first web 80 is created between the first and middle cavities and a second web 82 is created between the middle and second cavities.

The full length female end block 68 includes the connector cavity 18 on one end. The first cavity 74 is formed on the other end of the full length female end block 68 and a second cavity 84 is formed adjacent the connector cavity 18. The middle cavity 78 is formed between the first and second cavities. A first web 80 is created between the first and middle cavities and a second web 82 is created between the middle and second cavities. The full length end blocks 66, 68 have the same length as the in-line block 10.

The partial length male end block 70 includes the connector extension 16 on one end and a cavity 86 formed through thereof. The partial length female end block 72 includes the connector cavity 18 on one end and a cavity 88 formed through thereof.

The plurality of interlocking blocks are fabricated from concrete, composite material or any other suitable material. When the plurality of interlocking blocks are fabricated from concrete, they may be manufactured on a concrete block machine with suitable tooling. The top and bottom faces of the plurality of interlocking blocks may be secured to each other with a bonding agent other than mortar such as adhesive or even dry stacked.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of creating a wall, comprising the steps of:

forming a connector extension on one end of an in-line block, forming a connector cavity on the other end of said in-line block, said connector cavity being sized to receive said connector extension, said connector extension including opposed rounded ends, said connector cavity including opposed inner rounded ends that are sized to receive said opposed rounded ends;

extending a first retention projection from a face of said in-line block adjacent said connector extension, extending a second retention projection from said face of said in-line block adjacent said connector cavity; and forming a middle cavity through said in-line block, said middle cavity being sized to receive a first retention projection of a second in-line block and a second retention projection of a third in-line block.

2. The method of creating a wall of claim 1, further comprising the step of:

forming a first cavity between said connector extension and said middle cavity, forming a second cavity between said middle cavity and said connector cavity.

3. The method of creating a wall of claim 1, further comprising the step of:

forming an undercut side between said in-line block and each one of said opposed rounded ends.

4. The method of creating a wall of claim 1, further comprising the step of:

forming a front curved surface on said connector extension between said opposed rounded ends.

5. The method of creating a wall of claim 1, further comprising the step of:

providing a corner block with one of a corner connector extension and a corner connector cavity formed on one end and one of said corner connector cavity and said corner connector extension formed in a side at an opposite end thereof, said connector cavity being sized to receive said corner connector extension, said corner connector cavity being sized to receive said connector extension.

6. The method of creating a wall of claim 1, further comprising the step of:

providing an offset block with an offset connector extension formed on one side at one end thereof, an offset connector cavity being formed in an opposite side at the opposite end thereof, said connector cavity being sized to receive said offset connector extension, said offset connector cavity being sized to receive said connector extension.

7. The method of creating a wall of claim 1, further comprising the step of:

providing a male end block with an end connector extension formed on one end thereof, said connector cavity being sized to receive said end connector extension.

8. The method of creating a wall of claim 1, further comprising the step of:

providing a female end block with an end connector cavity formed on one end thereof, said end connector cavity being sized to receive said connector extension.

9. A method of creating a wall, comprising the steps of:

forming a connector extension on one end of an in-line block, forming a connector cavity on the other end of said in-line block, said connector cavity being sized to receive said connector extension;

forming one of a corner connector extension and a corner connector cavity on one end of a corner block and forming one of a corner connector cavity and a corner connector extension in a side of said corner block at an opposite end, said connector cavity being sized to receive said corner connector extension, said corner connector cavity being sized to receive said connector extension;

extending a first retention projection from a face of said in-line block adjacent said connector extension, extending a second retention projection from said face of said in-line block adjacent said connector cavity; and forming a middle cavity through said in-line block, said middle cavity being sized to receive a first retention projection of a second in-line block and a second retention projection of a third in-line block.

10. The method of creating a wall of claim 9, further comprising the step of:

said connector extension including opposed rounded ends, said connector cavity including opposed inner rounded ends that are sized to receive said opposed rounded ends.

11. The method of creating a wall of claim 10, further comprising the step of:

forming an undercut side between said in-line block and each one of said opposed rounded ends.

12. The method of creating a wall of claim 10, further comprising the step of:

forming a front curved surface on said connector extension between said opposed rounded ends.

13. The method of creating a wall of claim 9, further comprising the step of:

forming a first cavity between said connector extension and said middle cavity, forming a second cavity between said middle cavity and said connector cavity.

14. The method of creating a wall of claim 9, further comprising the step of:

providing an offset block with an offset connector extension formed on one side at one end thereof, an offset connector cavity being formed in an opposite side at the opposite end thereof, said connector cavity being sized to receive said offset connector extension, said offset connector cavity being sized to receive said connector extension.

15. The method of creating a wall of claim 9, further comprising the step of:

providing a male end block with an end connector extension formed on one end thereof, said connector cavity being sized to receive said end connector extension.

16. The method of creating a wall of claim 9, further comprising the step of:

providing a female end block with an end connector cavity formed on one end thereof, said end connector cavity being sized to receive said connector extension.

17. A method of creating a wall, comprising the steps of:

forming a connector extension on one end of an in-line block, forming a connector cavity on the other end of said in-line block, said connector cavity being sized to receive said connector extension, said connector extension including opposed rounded ends, said connector cavity including opposed inner rounded ends that are sized to receive said opposed rounded ends;

forming one of a corner connector extension and a corner connector cavity on one end of a corner block and forming one of a corner connector cavity and a corner connector extension in a side of said corner block at an opposite end, said connector cavity being sized to receive said corner connector extension, said corner connector cavity being sized to receive said connector extension;

extending a first retention projection from a face of said in-line block adjacent said connector extension, extending a second retention projection from said face of said in-line block adjacent said connector cavity; and forming a middle cavity through said in-line block, said middle cavity being sized to receive a first retention projection of a second in-line block and a second retention projection of a third in-line block.

18. The method of creating a wall of claim 17, further comprising the step of:

providing an offset block with an offset connector extension formed on one side at one end thereof, an offset connector cavity being formed in an opposite side at the opposite end thereof, said connector cavity being sized to receive said offset connector extension, said offset connector cavity being sized to receive said connector extension.

19. The method of creating a wall of claim 17, further comprising the step of:

providing a male end block with an end connector extension formed on one end thereof, said connector cavity being sized to receive said end connector extension.

20. The method of creating a wall of claim 17, further comprising the step of:

providing a female end block with an end connector cavity formed on one end thereof, said end connector cavity being sized to receive said connector extension.

* * * * *